US006364110B2

(12) United States Patent
Johnson

(10) Patent No.: US 6,364,110 B2
(45) Date of Patent: Apr. 2, 2002

(54) TRANSPORT CASE FOR PORTABLE EXPANDING FILE FOLDERS

(75) Inventor: Lynne B. Johnson, Fenton, MO (US)

(73) Assignee: Cardinal Brands, Inc., St. Louis, MO (US)

( * ) Notice: Subject to any disclaimer, the term of this patent is extended or adjusted under 35 U.S.C. 154(b) by 0 days.

(21) Appl. No.: 09/921,974

(22) Filed: Aug. 3, 2001

Related U.S. Application Data

(60) Provisional application No. 60/222,571, filed on Aug. 3, 2000.

(51) Int. Cl.[7] ..... B65D 77/26

(52) U.S. Cl. ..... 206/425; 190/901; 229/67.3

(58) Field of Search ..... 150/113; 190/110, 190/900, 901; 206/425; 229/67.3; 383/38–40

(56) References Cited

U.S. PATENT DOCUMENTS

| | | | | | |
|---|---|---|---|---|---|
| 329,676 | A | | 11/1885 | Reade | |
| 382,716 | A | * | 5/1888 | Matthews | 206/425 |
| 635,582 | A | | 10/1899 | Pedrick | |
| 821,019 | A | | 5/1906 | Cooke, Jr. | |
| 1,842,077 | A | | 1/1932 | Doughty | |
| 3,123,190 | A | * | 3/1964 | Lifton | 190/110 |
| 3,263,779 | A | * | 8/1966 | Bialer | 190/110 |
| 3,543,825 | A | * | 12/1970 | Dobbs | 150/113 |
| 4,263,951 | A | * | 4/1981 | Siegel | 150/113 |
| 4,265,286 | A | * | 5/1981 | Rapoport | 190/900 |
| 4,730,727 | A | | 3/1988 | Petroff | |
| 4,754,790 | A | * | 7/1988 | Meyers | 150/113 |
| 4,936,454 | A | | 6/1990 | Wang | |
| 4,974,652 | A | * | 12/1990 | Lemler | 229/67.3 |
| 4,988,038 | A | | 1/1991 | Mitsuyama | |
| 5,064,069 | A | | 11/1991 | Su | |
| 5,271,502 | A | | 12/1993 | Chang | |
| 5,630,509 | A | | 5/1997 | Su | |
| 5,664,724 | A | | 9/1997 | Ho | |
| 5,947,279 | A | | 9/1999 | Lee et al. | |

* cited by examiner

*Primary Examiner*—Jim Foster
(74) *Attorney, Agent, or Firm*—Lewis, Rice & Fingersh

(57) ABSTRACT

A carrying case for removably holding an expandable file folder, the carrying case including a body member having opposite end portions, the body member being foldable about a central axis between a substantially flat unfolded position and a folded closed position. In a preferred embodiment, the carrying case includes at least one tab member fixedly attached to each opposite end of the body member, each tab member being positioned and located to operatively engage one of the outer side walls of the expandable file folder when the file folder is positioned therewithin. Each tab member is bendable in a direction away from the body member so as to engage and overlap an edge portion of one of the outer side walls of the expandable file folder for removably holding the file folder within the carrying case such that when the carrying case is opened and closed, the file folder will open and close in unison therewith.

15 Claims, 3 Drawing Sheets

TRANSPORT CASE FOR PORTABLE EXPANDING FILE FOLDERS

CROSS REFERENCE TO RELATED APPLICATION

This application is based on and claims priority of Provisional Patent Application Ser. No. 60/222,571 for PORTABLE EXPANDING FILE WITH TRANSPORT CASE, filed Aug. 3, 2000, which is hereby incorporated by reference.

BACKGROUND OF INVENTION

The present invention relates generally to the field of filing devices and, more particularly, to an improved carrying case for removably and detachably holding a portable expanding file folder.

Accordion-like or expanding file folders are commonly used for storage of papers and the like. These folders are preferable to conventional file folders because they save space; they have the ability to expand to hold additional documents; and they allow for more careful and segregated organization of individual documents within the particular folder. Previously, expanding file folders have been designed either for desktop usage or with a closure flap for portability. If the documents housed within the folder have to be transported from one location to another, a user would merely pick up the file folder and carry it from location to location. The desktop version of the known expandable folders without a closure flap is not an optimum design for portability because the open top associated with these types of folders exposes the documents filed therewithin to the elements and there is a greater likelihood that the documents stored therein could fall out of the folder or otherwise become shuffled or rearranged during transportation. This often occurs due to improper handling or positioning of the folder during transportation, improper placement of the folder at a particular location, and/or dropping or otherwise knocking the flapless folder over onto its side. Although the known expandable file folders having a closure flap provide better portability than those without flaps, such folders likewise suffer from disadvantages in that repeated opening and closing of the closure flap leads to wear and tear at the hinge location and normal usage of the closure flaps will eventually lead to separation of the flap from the main body of the folder. In addition, although expanding file folders with flaps provide some protection to the documents contained therein from the elements, such folders are themselves exposed to the inclement weather and may be damaged by rain, snow or other environmental conditions since the known portable expandable file folders are primarily made from some type of paper material.

It is therefore desirable to provide a carrying case that can be used with a plurality of different expanding file folders, the carrying case having the ability to allow one expandable file folder to be easily installed and removed when desired, and thereafter allowing another expandable file folder to be reinstalled within the carrying case for transporting any particular file folder from one location to another. It is also desirable that such a carrying case allow for easy access to the documents contained within the expanding file folder, and that it provide for easy transport and protection of the documents contained therewithin.

Accordingly, the present invention is directed to overcoming one or more of the problems as set forth above.

SUMMARY OF INVENTION

The primary objective of the present invention is to provide a carrying case for expanding or accordion-like file folders wherein the carrying case allows for easy access to the documents contained within the expandable folder; it provides document security during transportation; and it provides protection to both the expanding file folder and the documents contained therein from the elements. In keeping with this objective, a carrying or transport case is provided with a holding mechanism by which any one of a plurality of known expandable file folders can be easily removably attached to the interior of the carrying case. In a preferred embodiment, flexible or resilient tab members are used to engage the side walls of the expandable folder when the folder is positioned within the carrying case, the tab members being positioned and located so as to engage and overlap an edge portion of each folder side wall. When installed, the carrying case becomes part of the file folder and can be used to expand and contract the individual pockets of the file folder in a normal fashion. Other means for removably holding the expandable file folder within the carrying case can likewise be utilized. The present carrying case may likewise include a wide variety of different closure mechanisms for securely closing the carrying case once the expandable folder is attached therewithin for easy grasping when transporting the file folder from one location to another. The present carrying case adds security, weather proofing, and style to the transportation of a basic expandable file folder.

BRIEF DESCRIPTION OF DRAWINGS

For a better understanding of the present invention, reference may be made to the accompanying drawings.

DETAILED DESCRIPTION

Figure 1:
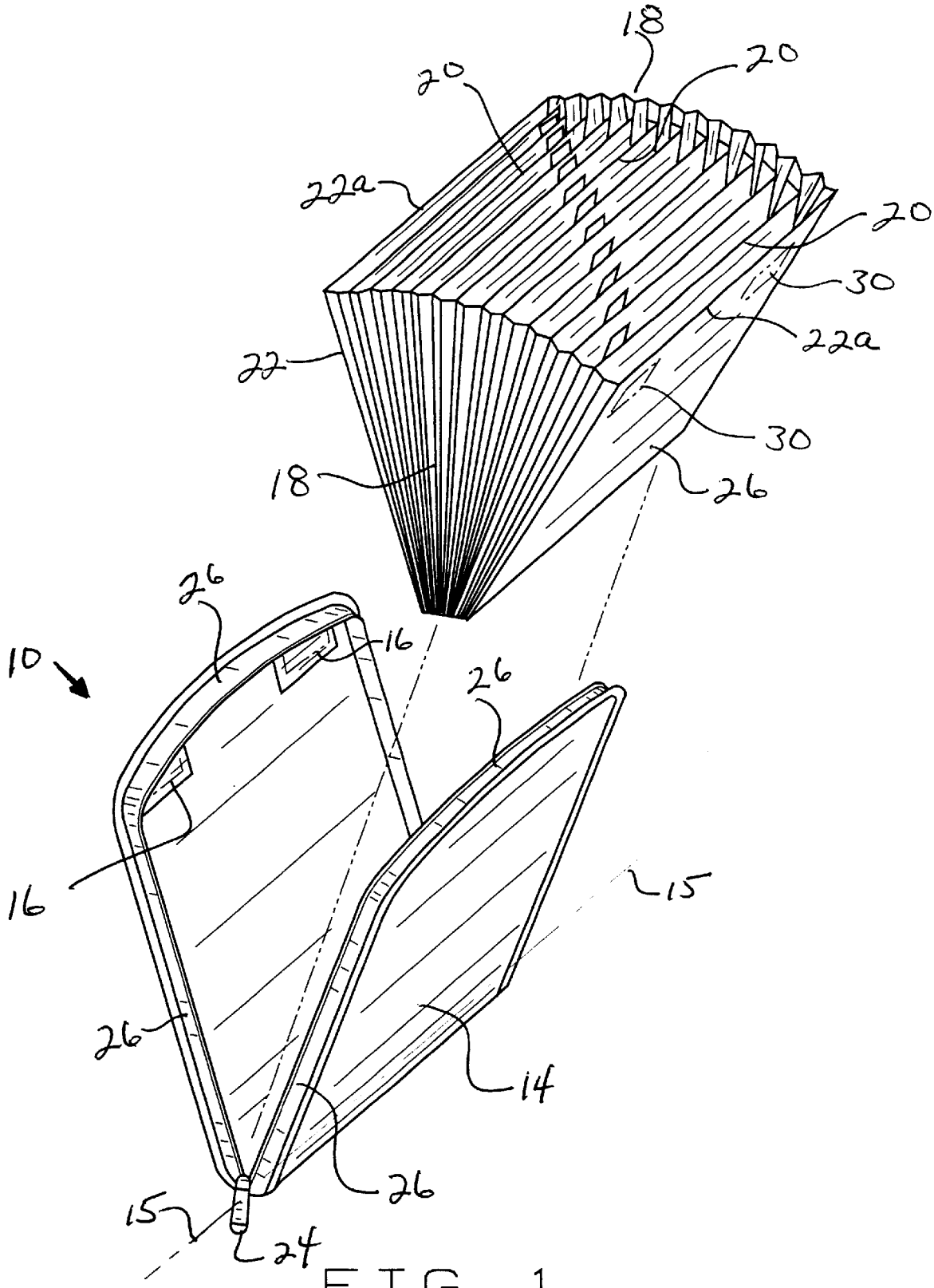
FIG. 1 is an exploded perspective view of the present carrying case and a typical expandable file folder positioned for insertion therewithin.
Figure 2:
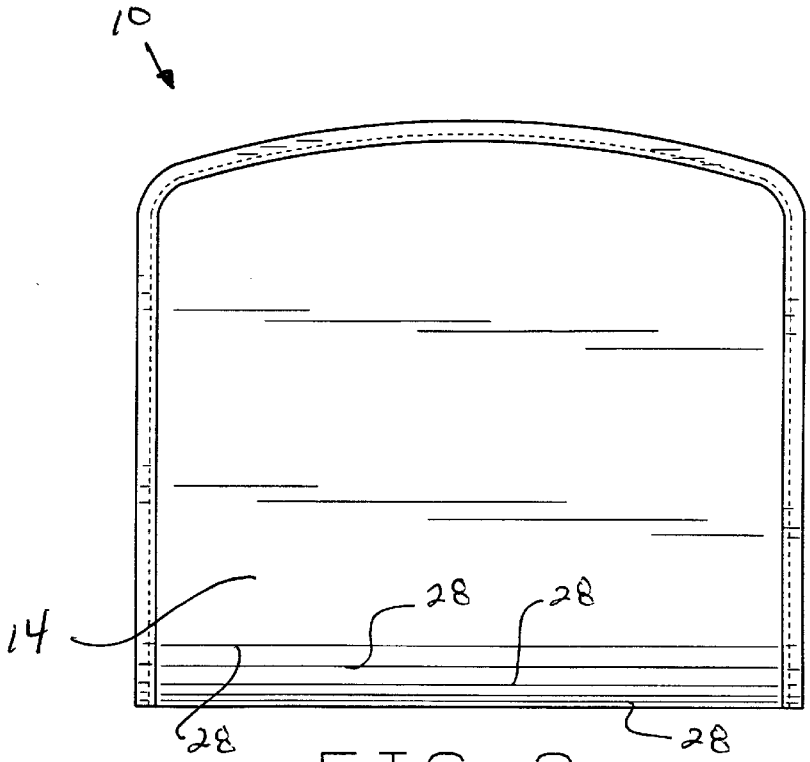
FIG. 2 is a side elevational view of the carrying case of FIG. 1.
Figure 3:
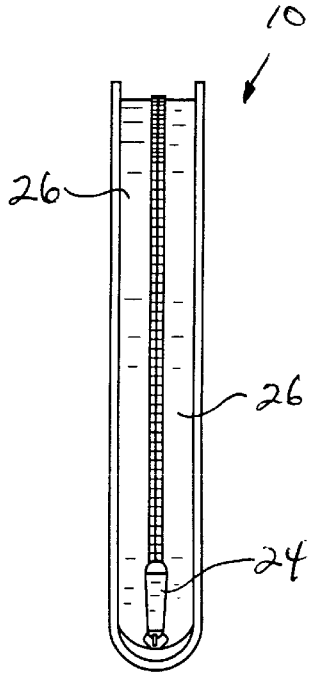
FIG. 3 is an end view of the carrying case of FIG. 1 illustrating one embodiment of a closure mechanism used to maintain the carrying case in its closed folded position.
Figure 4:
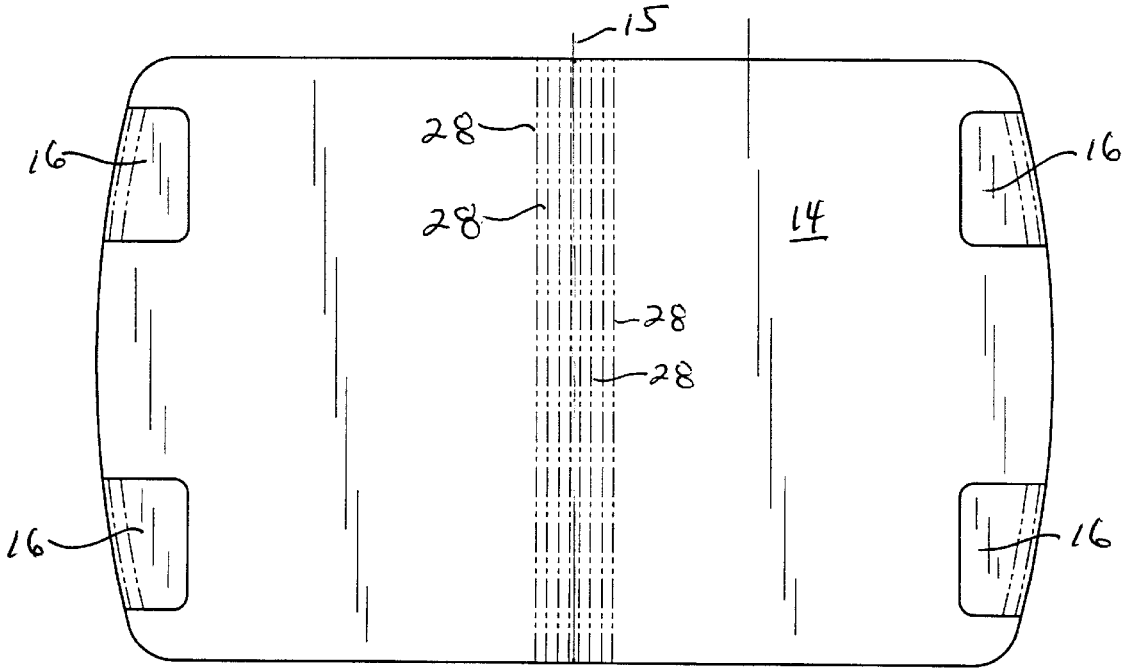
FIG. 4 is a top planform view of the carrying case of FIG. 1 in its substantially flat unfolded position.

Referring to the drawings more particularly by reference numbers wherein like numerals refer to like parts, number 10 in FIGS. 1–4 identifies a transport or carrying case 10 constructed in accordance with the teachings of the present invention, the carrying case 10 being specifically designed for removably holding and attaching a conventional expandable file folder 12 via a set of connectors 16 associated with the interior of the case 10. More particularly, carrying case 10 includes a body member 14 which is foldable about a central or transverse axis 15 between a substantially flat, open and unfolded position as best shown in FIG. 4 and a substantially closed folded position as best shown in FIG. 3. The body member 14 is preferably unitary in construction and can be fabricated from a wide variety of different materials such as from polypropylene, polyethylene, wrapped chipboard, wrapped and sealed vinyl, cloth, and other suitable materials. The carrying case 10 includes a pair of connectors 16 located at each opposite end of body member 14 as best shown in FIG. 4. In a preferred embodiment, the connectors 16 are resilient tab members each of which are fixed along at least a portion of one edge portion thereof to the interior surface of body member 14 in such a manner so as to be flexible or bendable in a direction away from the interior surface of body member 14. In this manner, the tab members 16 can be easily maneuvered into positions overlapping an edge portion of the respective outer side walls 22 of the expandable folder 12. This can be accomplished by either lifting the tab members 16 over the respective edge portions 22*a* of folder side walls 22, or the folder side wall edge portions 22*a* can be easily maneuvered and positioned under the tab members 16. Once the upper edge portions 22*a* of the expandable file folder side walls 22 have been positioned under the respective tab members 16, the folder 12 is securely held within the carrying case 10 and can be transported therewith as will be hereinafter explained.

Although the carrying case 10 illustrated in FIGS. 1–4 utilizes a pair of connectors or tab members 16 at each opposite end of the folder body member 14, it is recognized and anticipated that any number of connectors 16 could be utilized in association with the respective opposite end portions of folder body 14 depending upon the overall size of the carrying case 10, including using a single connector 16 at each opposite end thereof. It is also recognized that the individual connectors or tabs 16 can be attached or otherwise permanently affixed along at least a portion of one edge portion thereof to the interior surface of body member 14 through any conventional means such as by gluing, heat sealing, stitching or by using other suitable attaching or fastening means.

Expandable file folder 12 is of a conventional construction and may be likewise fabricated from a variety of materials, including paper, cardboard, file folder stock, and other materials similar to those used in fabricating carrying case 10. Expandable folder 12 includes outer side walls 22 having upper edge portions 22*a,* expandable end walls 18 and a plurality of individual partitions 20 which define a plurality of expandable pockets therebetween. The side walls 22 preferably have a greater thickness than the partitions 20 thereby providing added structural integrity to the overall folder. The upper edge side wall portions 22*a* slide beneath connectors 16 in the preferred embodiment of carrying case 10. Connectors 16 hold the file folder 12 firmly in place such that when the case 10 is opened and closed, the expandable folder 12 will open and close in unison therewith. Once installed, the expandable folder 12 can be carried from one location to another within the carrying case 10. The carrying case 10 provides security and protection to the folder 12 and the documents positioned therewithin during transport and it provides protection during times of inclement weather. Access to documents contained within the expandable folder 12 can be easily achieved by merely unfolding or opening the carrying case 10 in a normal fashion. Importantly, the expandable folder 12 can be easily disengaged from the connectors 16 by merely sliding or otherwise moving either the respective connectors 16 or the upper edge portions 22*a* of the outer side walls 22 in a direction so as to disengage the side wall edge portions 22*a* from under the connectors 16. Once this is accomplished, the expandable file folder 12 can be easily withdrawn from the carrying case 10 and another folder can be positioned and secured therewithin.

As best shown in FIG. 3, the carrying case 10 may likewise include a zipper member 24 for securely holding the carrying case 10 in its closed and carrying or transport position, the zipper member 24 providing additional security and protection to the expandable folder 12 and the documents contained therein. The zipper member 24 is attached to body portion 26 which extends substantially around and along the perimeter of body member 14 as best shown in FIG. 1. Body portion 26 could be made of a nylon material and could be integrally formed with body member 14, or body portion 26 could be otherwise attached to body member 14 by any suitable means. The carrying case 10 may be constructed with one or two zipper members, and it is recognized and anticipated that other closure mechanisms such as snap fasteners, clasp type closures, VELCRO fastening members and other similar mechanisms could be used in place of zipper member 24.

As best shown in FIGS. 2 and 4, the folder body member 14 may be scored or fluted along certain lines 28 in the vicinity of central axis 15 in order to increase the foldability and flexibility of carrying case 10. This scored or fluted spine area 28 facilitates the expanding of the file folder 12 as it is installed and used in conjunction with the carrying case 10. This scored or fluted area also facilitates opening and closing of the carrying case 10 during normal use and helps to extend the useful life of the case 10.

Figure 5:
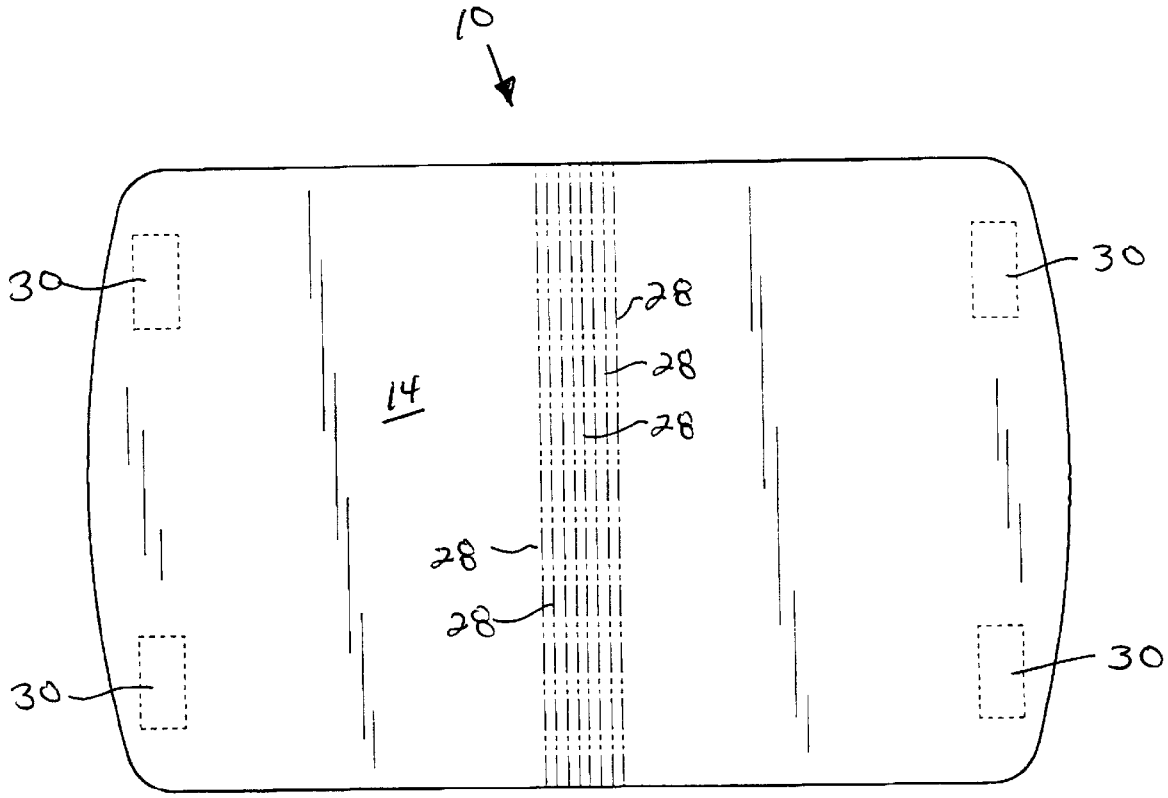
FIG. 5 is a top planform view of the carrying case similar to FIG. 4 illustrating other means for removably attaching an expandable file folder to the interior of the carrying case.

FIG. 5 illustrates another embodiment of carrying case 10 wherein the resilient tab connectors 16 can be replaced with a wide variety of different types of cooperatively engagable, connector means 30 such as cooperating snap fasteners, VELCRO fastening members, and other similar mechanisms. In this situation, the outer side walls 22 of expandable folder 12 will likewise include reciprocal cooperating connectors 30 as illustrated in FIG. 1 in order to complete the engagement. In this regard, the cooperatively engagable means 30 will be appropriately positioned and located on the interior surface of body member 14 and on the outer surface of folder side walls 22 such that when the expandable folder 12 is positioned within the carrying case 10, the cooperatively engagable connectors 30 will mate and engage with each other to securely hold the folder 12 in operative engagement within the carrying case 10. It is recognized and anticipated that still other types of connectors or attachment means could likewise be utilized without departing from the spirit and scope of the present invention. It is also recognized that the number and placement of the connectors 16 and 30 may vary depending upon the size and shape of the carrying case 10 and corresponding file folder 12. Still further, it is recognized that still other connecting means and still other modifications to the placement of the connectors 16 or 30 would be obvious to one of ordinary skill in the art.

As can be seen from the disclosure above, the carrying case 10 can be utilized to safely and securely transport documents positioned within an expandable folder from one location to another without worry that the documents will somehow become damaged or lost during the transportation process. The ease by which an expandable file folder can be installed, removed, and another folder reinstalled within the carrying case 10 further adds to the value and utility of the present invention.

As is evident from the foregoing description, certain aspects of the present invention are not limited by the particular details of the examples illustrated herein and it is therefore contemplated that other modifications and applications, or equivalence thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A combination carrying case and expandable file folder comprising:

an expandable file folder having outer side walls and expandable end portions, said file folder being sized and shaped so as to fit within said carrying case;

said carrying case including a body member having opposite end portions, said body member being foldable about a central axis between a substantially flat open position and a folded closed position;

at least one connector member associated with each opposite end of said body member, each of said connector members being positioned and located so as to operatively engage one of the outer side walls associated with said expandable file folder, each of said connector members removably holding said expandable file folder within said carrying case such that said file folder will open and close in unison with the opening and closing of said carrying case; and a closure device fixedly attached to said body member for maintaining said body member in its folded closed position;

wherein each of said connector members includes a tab member, each of said tab members being fixedly attached to said body member along at least a portion of one edge portion thereof such that said tab members are bendable in a direction away from said body member, each of said tab members overlapping a top edge of one of said outer side walls associated with said expandable file folder, said tab members removably holding said expandable file folder within said carrying case.

2. The combination carrying case and expandable file folder as set forth in claim 1 herein said body member includes a fluted spine area in the vicinity of said central axis.

3. The combination carrying case and expandable file folder as set forth in claim 1 wherein said closure device includes at least one zipper member.

4. The combination carrying case and expandable file folder as set forth in claim 1 wherein at least one of said tab members comprises a resilient tab member.

5. A combination carrying case and expandable file folder comprising:

an expandable file folder having outer side walls and expandable end portions, said file folder being sized and shaped so as to fit within said carrying case;

said carrying case including a body member having opposite end portions, said body member being foldable about a central axis between a substantially flat open position and a folded closed position, said carrying case configured such that when said carrying case is in said folded closed portion, said expandable file folder is substantially enclosed by said carrying case;

at least one connector member associated with each opposite end of said body member, each of said connector members being positioned within the area enclosed by said carrying case in said closed folded position, and located so as to operatively engage one of the outer side walls associated with said expandable file folder, each of said connector members removably holding said expandable file folder within said carrying case such that said file folder will open and close in unison with the opening and closing of said carrying case; and a closure device fixedly attached to said body member for maintaining said body member in its folded closed position;

wherein said connector members each include a cooperatively engageable snap type fastener, the outer side walls of said expandable file folder including corresponding cooperatively engageable snap type fasteners positioned and located for operatively engaging the snap type fasteners associated with said carrying case when said expandable file folder is positioned within said carrying case.

6. The combination carrying case and expandable file folder as set forth in claim 5 wherein said body member includes a fluted spine area in the vicinity of said central axis.

7. The combination carrying case and expandable file folder as set forth in claim 5 wherein said closure device includes at least one zipper member.

8. A combination carrying case and expandable file folder comprising:

an expandable file folder having outer side walls and expandable end portions, said file folder being sized and shaped so as to fit within said carrying case;

said carrying case including a body member having opposite end portions, said body member being foldable about a central axis between a substantially flat open position and a folded closed position, said carrying case configured such that when said carrying case is in said folded closed portion, said expandable file folder is substantially enclosed by said carrying case;

at least one connector member associated with each opposite end of said body member, each of said connector members being positioned within the area enclosed by said carrying case in said closed folded position, and located so as to operatively engage one of the outer side walls associated with said expandable file folder, each of said connector members removably holding said expandable file folder within said carrying case such that said file folder will open and close in unison with the opening and closing of said carrying case; and a closure device fixedly attached to said body member for maintaining said body member in its folded closed position;

wherein said connector members each include a cooperatively engageable hook and loop fastener member, the outer side walls of said expandable file folder including corresponding cooperatively engageable hook and loop fastener members positioned and located for operatively engaging the hook and loop fastener members associated with said carrying case when said expandable file folder is positioned within said carrying case.

9. The combination carrying case and expandable file folder as set forth in claim 8 wherein said body member includes a fluted spine area in the vicinity of said central axis.

10. The combination carrying case and expandable file folder as set forth in claim 8 wherein said closure device includes at least one zipper member.

11. A combination carrying case and expandable file folder comprising:

an expandable file folder having outer side walls and expandable end walls, said expandable file folder being sized and shaped for storage within said carrying case, said carrying case including a unitary body member having opposite end portions, said body member being foldable about a central axis between a substantially flat unfolded open position and a substantially folded closed position;

at least one tab member fixedly attached to each opposite end of said body member, each of said tab members being bendable in a direction away from said body member and cooperatively engaging and overlapping a top edge of the respective outer side walls of said expandable file folder, said tab members removably holding said expandable file folder within said carrying case such that said file folder will open and close in unison with the opening and closing of said carrying case; and a closure device fixedly attached to said body member for maintaining said body member in its closed folded position.

12. The combination carrying case and expandable file folder as set forth in claim 11 wherein said body member includes a fluted spine area in the vicinity of said central axis.

13. The combination carrying case and expandable file folder as set forth in claim 11 wherein said body member includes a body portion extending substantially along the length of the perimeter thereof, said closure device being fixedly attached to said body portion.

14. The combination case and expandable file folder as set forth in claim 11 wherein said body member substantially encloses said file folder when said file folder is closed.

15. A combination carrying case and expandable file folder comprising:

an expandable file folder having outer side walls and expandable end portions, said file folder being sized and shaped so as to fit within said carrying case;

said carrying case including a body member having opposite end portions, said body member being foldable about a central axis between a substantially flat open position and a folded closed position such that when said carrying case is in said folded closed portion, said expandable file folder is substantially enclosed by said carrying case;

at least one connector member associated with each opposite end of said body member, each of said connector members being positioned within the area enclosed by said carrying case in said closed folded position, and located so as to operatively engage one of the outer side walls associated with said expandable file folder, each of said connector members removably holding said expandable file folder within said crying case such that said file folder will open and close in unison with the opening and closing of said carrying case; and a closure device fixedly attached to said body member for maintaining said body member in its folded closed position;

wherein at least one of said connector members associated with each said opposite end includes at least one of:

a tab member, each of said tab members being fixedly attached to said body member along at least a portion of one edge portion thereof such that said tab members are bendable in a direction away from said body member, each of said tab members overlapping a top edge of one of said outer side walls associated with said expandable file folder, said tab members removably holding said expandable file folder within said carrying case;

a cooperatively engageable snap type fastener, the outer side walls of said expandable file folder including corresponding cooperatively engageable snap type fasteners engaging the snap type fasteners associated with said carrying case; and a cooperatively engageable hook and loop fastener member, the outer side walls of said expandable file folder including corresponding cooperatively engageable hook and loop fastener members engaging the hook and loop fastener members associated with said carrying case.

* * * * *